US006074006A

United States Patent [19]

Milosic et al.

[11] Patent Number: 6,074,006

[45] Date of Patent: Jun. 13, 2000

[54] AUTOMOTIVE SEAT WITH PNEUMATIC PELVIC STABILIZATION

[75] Inventors: Mari C. Milosic, Grosse Pointe Park; Philip W. Hadley, West Bloomfield; Manoj Srivastava, Rochester Hills, all of Mich.

[73] Assignee: Magna Interior Systems, Inc., Aurora, Canada

[21] Appl. No.: 09/316,593

[22] Filed: May 21, 1999

[51] Int. Cl.[7] ..... A47C 4/54

[52] U.S. Cl. ..... 297/284.6; 297/284.4

[58] Field of Search ..... 5/654, 655.3; 297/284.9, 297/284.3, 284.4, 284.5, 284.6, 284.1, DIG. 3

[56] References Cited

U.S. PATENT DOCUMENTS

| | | |
|---|---|---|
| 3,145,054 | 8/1964 | Sopko, Jr. . |
| 3,326,601 | 6/1967 | Vanderbilt et al. . |
| 3,330,598 | 7/1967 | Whiteside . |
| 3,348,880 | 10/1967 | Swann . |
| 3,363,941 | 1/1968 | Wierwille . |
| 3,540,776 | 11/1970 | Wilson . |
| 3,652,126 | 3/1972 | Folling . |
| 3,770,315 | 11/1973 | Smittle et al. . |
| 3,982,786 | 9/1976 | Burgin et al. . |
| 4,444,430 | 4/1984 | Yoshida et al. . |
| 4,516,568 | 5/1985 | Baxter et al. . |
| 4,552,402 | 11/1985 | Huber et al. . |
| 4,580,837 | 4/1986 | Bayley . |
| 4,592,588 | 6/1986 | Isono et al. . |
| 4,615,563 | 10/1986 | Kobayashi . |
| 4,634,179 | 1/1987 | Hashimoto et al. . |
| 4,655,505 | 4/1987 | Kashiwamura et al. . |
| 4,707,027 | 11/1987 | Horvath et al. . |
| 4,722,550 | 2/1988 | Imaoka et al. . |
| 4,960,304 | 10/1990 | Frantz . |
| 4,965,899 | 10/1990 | Sekido et al. . |
| 5,135,282 | 8/1992 | Pappers . |
| 5,155,685 | 10/1992 | Kishi et al. . |
| 5,263,765 | 11/1993 | Nagashima et al. . |
| 5,320,409 | 6/1994 | Katoh et al. . |
| 5,505,518 | 4/1996 | Pike . |
| 5,823,620 | 10/1998 | Le Caz . |
| 5,967,608 | 10/1999 | Van Sickle . |

FOREIGN PATENT DOCUMENTS

| | | | |
|---|---|---|---|
| 0099236 | 7/1982 | European Pat. Off. . | |
| 0109572 | 5/1984 | European Pat. Off. . | |
| 267348 | 12/1968 | Germany | 297/284.6 |
| 2191690 | 7/1986 | United Kingdom . | |

*Primary Examiner*—Milton Nelson, Jr.
*Attorney, Agent, or Firm*—Howard & Howard

[57] ABSTRACT

An automotive seat assembly comprising a seat cushion and a seat back. The seat back includes opposing sides defining a center line there between and a lower pelvic support region for supporting the pelvic area of a seat occupant. An inflatable bladder assembly is supported by the seat back and includes a pair of bladders positioned on opposing sides of the center line in the pelvic support region which are expandable by a fluid medium from a generally flat uninflated condition to a generally wedge-shaped inflated condition. A controller activates a fluid pump and valve to control the bladders between the uninflated and inflated conditions. When the bladders are expanded to the inflated condition, the wedge-shape of the bladders cradles the spine and pelvic bone of the seat occupant to control pelvic rocking and reduce spinal muscle fatigue.

10 Claims, 1 Drawing Sheet

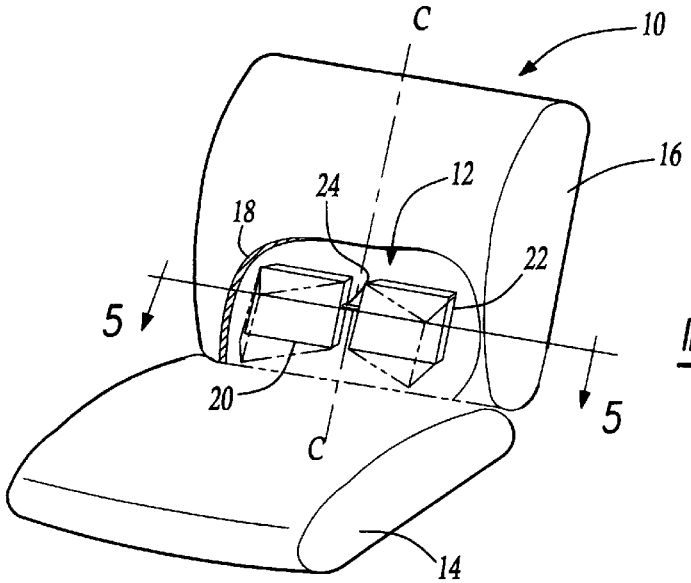
Fig-1
Fig-2
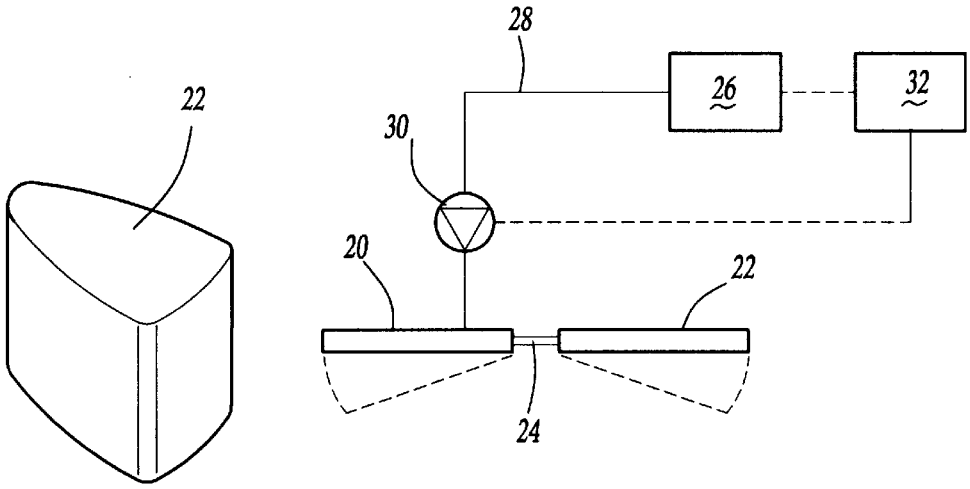
Fig-3
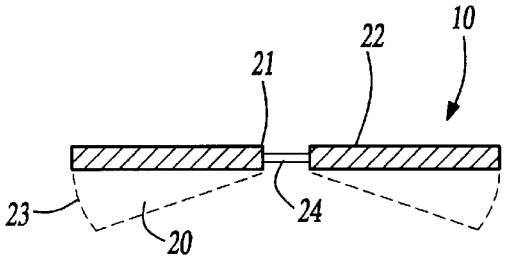
Fig-5
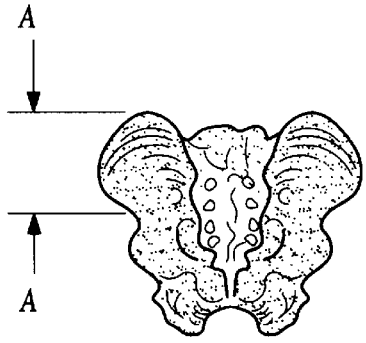
Fig-4

AUTOMOTIVE SEAT WITH PNEUMATIC PELVIC STABILIZATION

FIELD OF THE INVENTION

The subject invention relates to an automotive seat having pneumatic pelvic stabilization. In particular, the subject invention relates to an automotive seat which controls pelvis rocking thereby reducing muscular effort for spinal stabilization.

BACKGROUND OF THE INVENTION

The design of automotive seating is especially challenging because of the dynamic environment. Automotive seats have been designed to be contoured to the human shape, with seat backs generally contoured to the spinal shape.

Road and vehicle vibrations are transmitted through the seat to the occupant thereof. This vibrational input challenges the spinal musculature as the musculature attempts to compensate for small pelvic movement. This will, over time, lead to occupant discomfort and low back pain.

Low back pain problems have been addressed by providing some form of lumbar support. U.S. Pat. No. 4,580,837 illustrates a typical rectangular inflatable lumbar support pad. The lumbar support pad is predicated on the assumption that since the spine is curved when a person is standing, this same curve should be assumed while sitting. However, providing lumbar support does not stabilize the spine and therefore does nothing to reduce fatigue of the spinal muscles.

The disadvantages of the prior art may be overcome by providing an automotive seat having pneumatic pelvic stabilization.

SUMMARY OF THE INVENTION

An automotive seat assembly comprises a generally horizontal seat cushion and a generally upright seat back. The seat back includes a lower pelvic support region and opposing sides defining a vertical center line there between and a lower pelvic support region. An inflatable bladder assembly is supported by the seat in the lower pelvic support region and comprises a pair of bladders positioned on opposite sides of the center line wherein each of the bladders is expandable form an uninflated condition with the bladders substantially flat and an inflated condition forming opposing wedge-shaped bladders on each side of the center line adapted to cradle and support the spine of an occupant of the seat along the lower pelvic support region.

According to another aspect of the invention, a pelvic stabilization assembly for use in a seat back comprises an inflatable bladder assembly adapted to be supported by the seat back. The inflatable bladder assembly comprises a pair of bladders wherein each of the bladders is expandable from an uninflated condition with the bladders substantially flat and an inflated condition forming opposing wedge-shaped bladders adapted to cradle and support the pelvic area of an occupant seated against the seat back.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 is a perspective view of a seat, partially broken away, to illustrate the inflatable bladder assembly of the present invention;

FIG. 2 is a schematic view of the inflatable bladder assembly of FIG. 1;

FIG. 3 is a perspective view of one of the inflatable bladders of FIG. 1 in an inflated condition;

FIG. 4 is an anterior view of a human pelvic bone illustrating the preferred positioning of the present invention; and FIG. 5 is a cross-sectional view taken along line 5—5 of FIG. 1.

DETAILED DESCRIPTION OF THE INVENTION

Referring to the Figures wherein like numerals reference like or corresponding parts throughout the several views, FIG. 1 discloses a seat 10 incorporating the inflatable bladder assembly 12 of the present invention. The seat 10 is of conventional construction comprising a seat cushion 14 and a seat back 16. Each of the seat cushion 14 and seat back 16 typically comprise a support frame for supporting a contoured foam pad encased in a seat cover 18 as is commonly known in the art. The inflatable bladder assembly 12 is mounted inside of seat back 16 under the seat cover 18. It should be appreciated that the inflatable bladder assembly 12 may be mounted to the support frame of the seat 10 or alternatively positioned between the seat cover 18 and foam pad or recessed within the foam pad adjacent to the seat cover 18 without varying from the scope of the present invention.

The inflatable bladder assembly 12 comprises a pair of opposed wedge-shaped bladders 20, 22 which are in fluid communication via a connecting tube 24. When in an uninflated condition, the bladders 20, 22 are substantially flat. When in an inflated condition, the bladders 20, 22 are wedge-shaped and opposed to each other, as illustrated by the dashed lines in FIG. 2. FIG. 3 illustrates the inflatable bladder 22 in an inflated condition. Preferably, each bladder 20, 22 is fabricated from a polymer material.

Referring to FIG. 5, each of the inflated wedge-shaped bladders 20, 22 includes a first end 21 adjacent the center line C—C having a first cross-sectional width and a second end 23 extending away from the center line C—C having a second cross-sectional width larger than the first cross-sectional width wherein each of the inflated bladders 20, 22 has a generally wedge-shaped cross-section.

The inflatable bladder assembly 12 also comprises a pump 26 in fluid communication with the bladders 20, 22 via hose 28 through a valve 30. A controller 32 is operatively connected to the pump 26 and the valve 30 for controlling the operation of the inflatable bladder assembly 12.

Bladders 20, 22 are laterally positioned along opposite sides of the center-line, illustrated by line C—C, of the seat back 16 such that bladders 20, 22 will cradle the spine of the occupant of the seat 10. Further, the bladders 20, 22 are preferably vertically positioned above the upper surface of the seat cushion 14 to provide support for the ilium or upper half of the pelvic bone as shown by the line A—A in FIG. 4.

Optionally, the bladders 20, 22 could be separate without the connecting tube 24. However, each bladder 20, 22 would then be independently connected to the pump 26 for inflation.

If the occupant of the seat desires to initiate the inflatable bladder assembly 12 of the present invention, the occupant activates the controller 32. The controller 32 activates the valve 30 to an inflate condition and then activates pump 26.

Pump 26 inflates the bladders 20, 22 until each is in a wedge-shape having desired firmness.

The opposed wedge-shape presented by the bladders 20, 22 cradles the pelvic bone to control pelvic rocking. Controlling pelvic rocking reduces the muscular effort necessary for spinal stabilization and thus improves occupant comfort by reducing spinal fatigue.

To deflate, the occupant reverses the controller 32 which then switches valve 30 to an exhaust condition. Air is allowed to escape through valve 30 to the atmosphere. Valve 30 can optionally be provided with a relief valve to prevent overinflation of the bladders 20, 22.

The present invention has been described using air as the working fluid in an open system for inflation of the bladders 20, 22. However, it can now be readily understood by those skilled in the art that other working fluids, both liquids and gasses, could also be used and that a closed system could be used with satisfactory results.

The above-described embodiment of the invention is intended to be an example of the present invention and alterations and modifications may be effected thereto, by those of skill in the art without departing from the scope of the invention. It is, therefore, to be understood that within the scope of the appended claims, the invention may be practiced other than as specifically described.

What is claimed is:

1. An automotive seat assembly comprising:

a generally horizontal seat cushion;

a generally upright seat back, said seat back having a lower pelvic support region and opposing sides defining a vertical center line there between;

an inflatable bladder assembly supported by said seat back in said lower pelvic support region, said inflatable bladder assembly comprising a pair of bladders positioned on opposite sides of said center line wherein each of said bladders is expandable from an uninflated condition with said bladders being substantially flat and an inflated condition forming opposing wedge-shaped bladders on each side of said center line adapted to cradle and support a spine of an occupant of said seat back along said lower pelvic support region; and a pump in fluid communication with said bladders for expanding said bladders with a fluid medium to said inflated condition.

2. An automotive seat assembly as set forth in claim 1 further including a connecting tube for interconnecting and providing fluid communication between said opposing bladders.

3. An automotive seat assembly as set forth in claim 1 further including a controller operatively connected to said bladders for controlling the expansion of said bladders between said uninflated and inflated conditions.

4. An automotive seat assembly as set forth in claim 3 further including a valve connected between said bladders and said pump for controlling said expansion of said bladders with said fluid medium from said pump and for exhausting said fluid from said bladders in said uninflated condition.

5. An automotive seat assembly as set forth in claim 4 further including a hose interconnecting and in fluid communication between said pump, valve and bladders.

6. An automotive seat assembly as set forth in claim 1 wherein each of said inflated wedge-shaped bladders include a first end adjacent said center line having a first cross-sectional width and a second end extending away from said center line having a second cross-sectional width larger than said first cross-sectional width wherein each of said bladders has a generally wedge-shaped cross-section.

7. A pelvic stabilization assembly for use in a seat back comprising:

an inflatable bladder assembly adapted to be supported by the seat back, said inflatable bladder assembly comprising a pair of bladders wherein each of said bladders is expandable from an uninflated condition with said bladders being substantially flat and an inflated condition forming opposing wedge-shaped bladders adapted to cradle and support a pelvic area of an occupant seated against the seat back; and a pump in fluid communication with said bladders for expanding said bladders with a fluid medium to said inflated condition.

8. A pelvic stabilization assembly as set forth in claim 7 further including a connecting tube for interconnecting and providing fluid communication between said opposing bladder.

9. A pelvic stabilization assembly as set forth in claim 7 further including a valve connected between said bladders and said pump for controlling said expansion of said bladders in said inflated condition and for exhausting said fluid medium from said bladders in said uninflated condition.

10. A pelvic stabilization assembly as set forth in claim 9 further including a controller operatively connected to said pump and said valve for controlling the expansion of said bladders between said uninflated and inflated conditions.

* * * * *